US010968790B2

(12) United States Patent
Raimondi et al.

(10) Patent No.: US 10,968,790 B2
(45) Date of Patent: Apr. 6, 2021

(54) ACTUATION APPARATUS

(71) Applicant: Eaton Intelligent Power Limited, Dublin (IE)

(72) Inventors: Emanuele Raimondi, San Francesco al Campo (IT); Nicola Andrisani, Cumiana (IT)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 16/636,944

(22) PCT Filed: Aug. 6, 2018

(86) PCT No.: PCT/EP2018/071289
§ 371 (c)(1),
(2) Date: Feb. 6, 2020

(87) PCT Pub. No.: WO2019/030180
PCT Pub. Date: Feb. 14, 2019

(65) Prior Publication Data

US 2020/0271023 A1 Aug. 27, 2020

(30) Foreign Application Priority Data

Aug. 7, 2017 (GB) ..... 1712662

(51) Int. Cl.
*F01L 1/34* (2006.01)
*F01L 13/00* (2006.01)
(Continued)

(52) U.S. Cl.
CPC ..... *F01L 13/0005* (2013.01); *F01L 1/185* (2013.01); *F01L 1/2405* (2013.01);
(Continued)

(58) Field of Classification Search
CPC . F01L 13/0005; F01L 13/185; F01L 13/2405; F01L 2305/00; F01L 13/0036;
(Continued)

(56) References Cited

U.S. PATENT DOCUMENTS 5,584,267 A 12/1996 Muir
5,653,198 A 8/1997 Diggs
(Continued)

FOREIGN PATENT DOCUMENTS

EP 0735249 A1 10/1996
EP 1544422 A 6/2005
WO WO 2017144706 A1 8/2017

*Primary Examiner* — Zelalem Eshete
(74) *Attorney, Agent, or Firm* — Leydig, Voit & Mayer, Ltd.

(57) ABSTRACT

An actuation apparatus actuates a latching arrangement of a switchable valve train component of an internal combustion engine. The apparatus includes: a lever configured to contract an actuation source and configured to contact the latching arrangement; and a bias. The bias contacts the lever. The bias is configured such that, in use, the bias becomes biased by the lever when the actuation source moves the lever when the actuation source attempts to actuate the latching arrangement, via the lever, when the latching arrangement is non-actuatable, whereby the bias causes the lever to actuate the latching arrangement when the latching arrangement is actuatable again.

16 Claims, 10 Drawing Sheets

(51) Int. Cl.

| | |
|---|---|
| ***F01L 1/18*** | (2006.01) |
| *F01L 1/24* | (2006.01) |
| *F01L 1/46* | (2006.01) |

(52) U.S. Cl.
CPC ..... *F01L 13/0036* (2013.01); *F01L 2001/186* (2013.01); *F01L 2001/467* (2013.01); *F01L 2013/001* (2013.01); *F01L 2305/00* (2020.05)

(58) Field of Classification Search
CPC ..... F01L 2001/186; F01L 2001/467; F01L 2013/001; F01L 2800/10; F01L 2013/103; F01L 2800/08
See application file for complete search history.

(56) References Cited

U.S. PATENT DOCUMENTS

| | | | | |
|---|---|---|---|---|
| 5,682,848 | A | 11/1997 | Hampton et al. | |
| 6,499,451 | B1 * | 12/2002 | Hendriksma ..... | F01L 1/08 123/90.16 |
| 2017/0241300 | A1 | 8/2017 | McCarthy, Jr. et al. | |

* cited by examiner

ACTUATION APPARATUS

CROSS-REFERENCE TO PRIOR APPLICATIONS

This application is a U.S. National Phase application under 35 U.S.C. § 371 of International Application No. PCT/EP2018/071289, filed on Aug. 6, 2018, and claims benefit to British Patent Application No. GB 1712662.4, filed on Aug. 7, 2017. The International Application was published in English on Feb. 14, 2019, as WO 2019/030180 under PCT Article 21(2).

FIELD

The present invention relates to actuation, and more specifically actuation of a latching arrangement of a switchable engine or valve train component of an internal combustion engine.

BACKGROUND

Internal combustion engines may include switchable engine or valve train components. For example, valve train assemblies may include a switchable rocker arm to provide for control of valve actuation by alternating between at least two or more modes of operation (e.g., valve-lift modes). Such rocker arms typically involve multiple bodies, such as an inner arm and an outer arm. These bodies are latched together to provide one mode of operation (e.g., a first valve-lift mode) and are unlatched, and hence can pivot with respect to each other, to provide a second mode of operation (e.g., a second valve-lift mode). Typically, a moveable latch pin is used and actuated and de-actuated to switch between the two modes of operation.

The transmission of an actuation force to a switchable valve train or engine component such as a switchable rocker arm can be difficult due to packaging constraints and functional requirements. Also, in some cases, actuation may not be possible immediately due to an engine condition.

SUMMARY

An embodiment of the present invention provides an actuation apparatus that actuates a latching arrangement of a switchable valve train component of an internal combustion engine. The apparatus includes: a lever configured to contract an actuation source and configured to contact the latching arrangement; and a bias. The bias contacts the lever. The bias is configured such that, in use, the bias becomes biased by the lever when the actuation source moves the lever when the actuation source attempts to actuate the latching arrangement, via the lever, when the latching arrangement is non-actuatable, whereby the bias causes the lever to actuate the latching arrangement when the latching arrangement is actuatable again.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
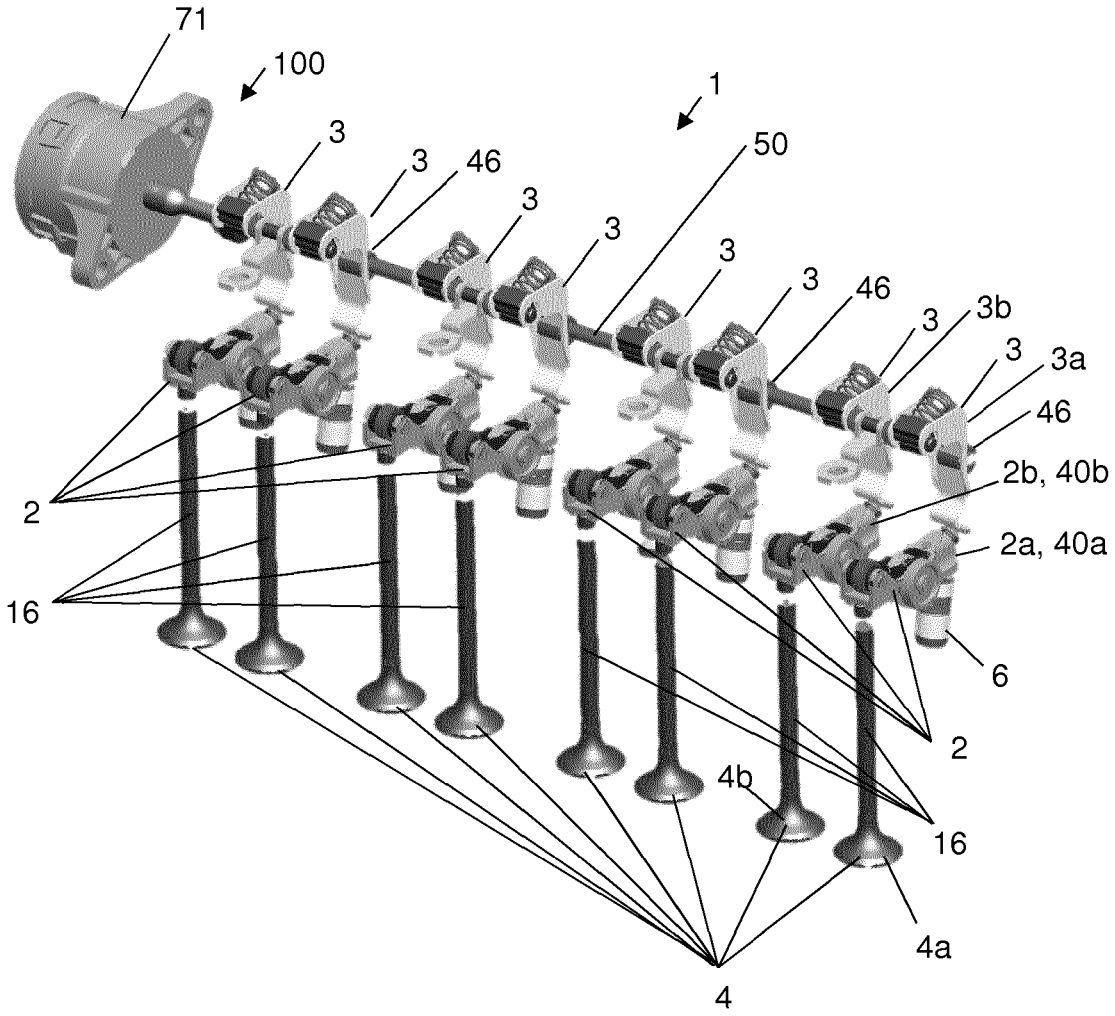
FIG. 1 illustrates schematically a perspective view of a valve train assembly according to an example.
Figure 2:
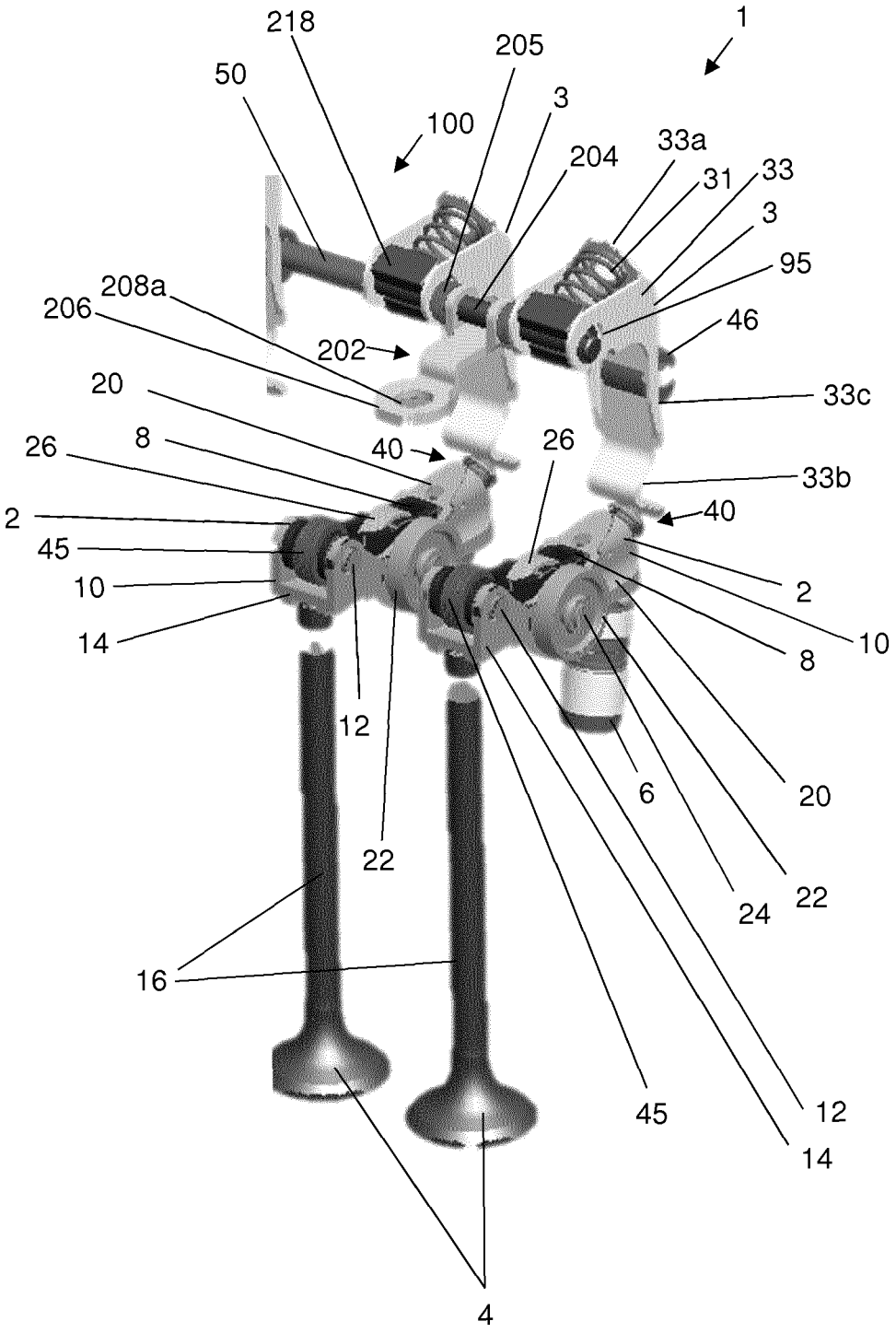
FIG. 2 illustrates schematically a detail of the perspective view of FIG. 1.
Figure 3:
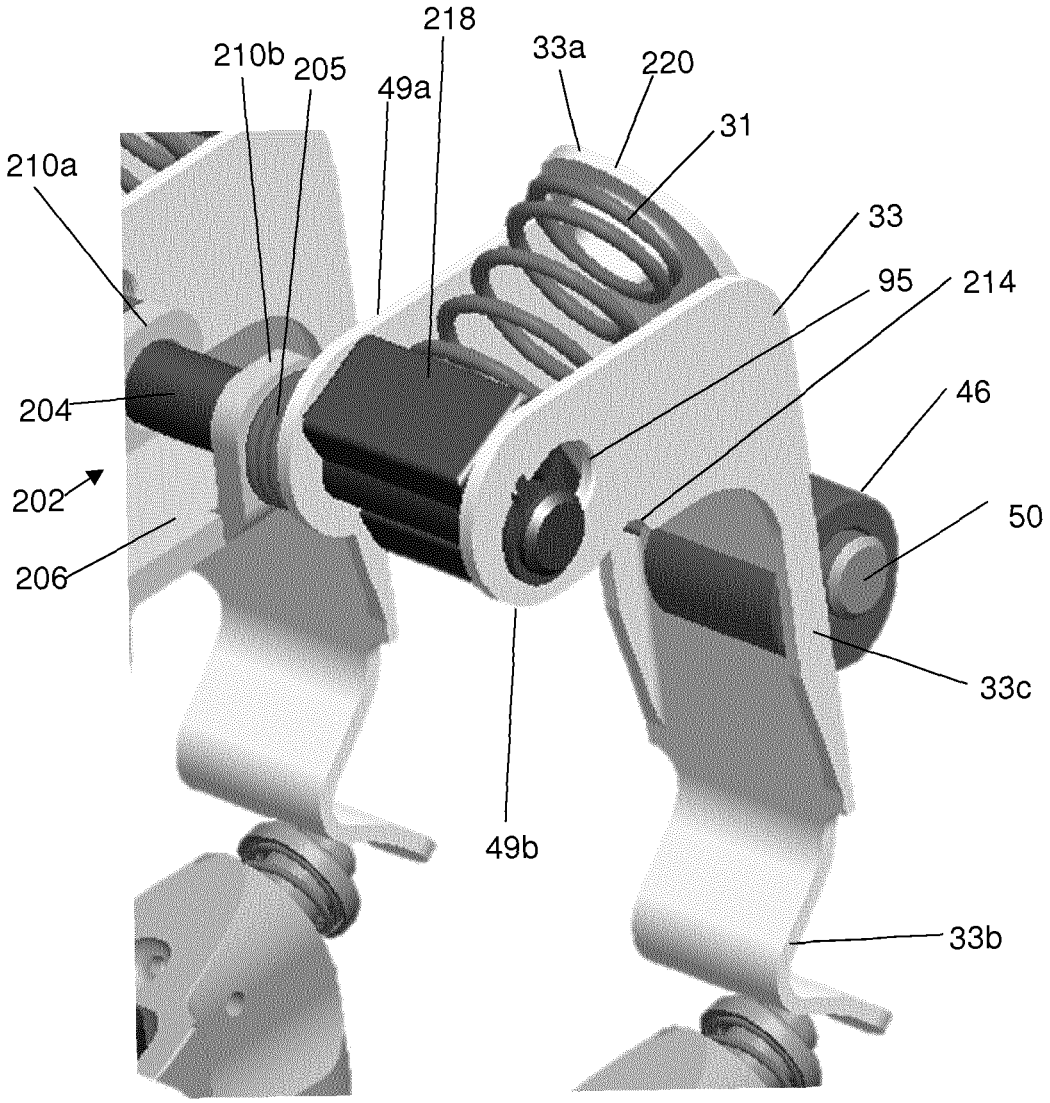
FIG. 3 illustrates schematically a detail of the perspective view of FIG. 2.

According to a first aspect of the present disclosure there is provided an actuation apparatus for actuating a latching arrangement of a switchable valve train component of an internal combustion engine. The apparatus includes: a lever for contacting an actuation source and for contacting the latching arrangement; and a biasing means. The biasing means contacts the lever, where, in use, the biasing means becomes biased by the lever when the actuation source moves the lever when the actuation source attempts to actuate the latching arrangement, via the lever, when the latching arrangement is non-actuatable, whereby the biasing means causes the lever to actuate the latching arrangement when the latching arrangement is actuatable again.

FIGS. 1 to 7 illustrate schematically an example valve train assembly 1 including rocker arms 2 according to an example. Although the example rocker arm 2 is referred to in the below, it will be appreciated that the rocker arm 2 may be any rocker arm including a plurality of bodies that move relative to one another, and which are latched together to provide one mode of operation (e.g. a latched valve-lift mode) and are unlatched, and hence can move with respect to each other, to provide a second mode of operation (e.g. an unlatched valve-lift mode).

Referring again to the example of FIGS. 1 to 7, a valve train assembly 1 includes a plurality (in this example, eight) rocker arms 2 controlling a respective plurality of engine valves 4 (in this example, exhaust valves 4) of cylinders of an internal combustion engine. Specifically, there are four cylinders with two exhaust valves 4 per cylinder. Each rocker 2 is supported by a lash adjustor 6. The valve train assembly 1 includes an actuation source 100 and a plurality of actuation apparatuses 3, one for each rocker arm 2.

As seen in FIG. 2 and FIGS. 5 to 7, each rocker arm 2 includes an inner body or arm 8 and an outer body or arm 10. The inner body 8 is pivotally mounted on a shaft 12 which serves to link the inner body 8 and outer body 10 together. A first end 14 of the outer body 10 engages the stem 16 of the associated valve 4 and at a second end 20 of the outer body 10 is mounted for pivotal movement on the associated lash adjustor 6, which is supported in an engine block. The lash adjuster 6, which may for example be a hydraulic lash adjuster, is used to accommodate slack between components in the valve train assembly 1. Lash adjusters are well known per se and so the lash adjuster 6 will not be described in detail.

Each rocker arm 2 includes a latching arrangement 40 including a latch pin 80 for latching and unlatching the inner body 8 and the outer body 10. The latch pin 80 is received for sliding movement in a bore 81 in the outer body 8. Each latching arrangement 40 is actuatable (moveable) by the actuation apparatus 3 between a first position in which the inner body 8 and the outer body are unlatched (see, e.g., FIG. 5), and a second position in which the inner body 8 and the outer body 10 are latched together (see, e.g., FIG. 6). The actuation apparatus 3 is arranged to actuate the latching arrangement 40 from the first position to the second position. The rocker arm 2 includes a biasing means (a bias, e.g., a return spring) 41 to bias the latching arrangement 40 from the second position to the first position.

Each rocker arm 2 is provided with a pair of main lift rollers 22 (only one per rocker arm 2 is shown in the Figures) rotatably mounted on an axle 24 carried by the outer body 10. The rocker arm 2 is further provided with a secondary lift roller 26, located within the inner body 8. The secondary lift roller 26 is mounted on a hollow inner bushing/axle 43. The axle 24 extends through the inner bushing/axle 43 (and hence through the inner roller 26) and the diameter of the axle 24 is somewhat smaller than the inner diameter of the inner bushing/axle 43 to allow movement of the assembly of the inner body 8, axle 43 and inner roller 26 relative to the outer body 10.

Figure 5:
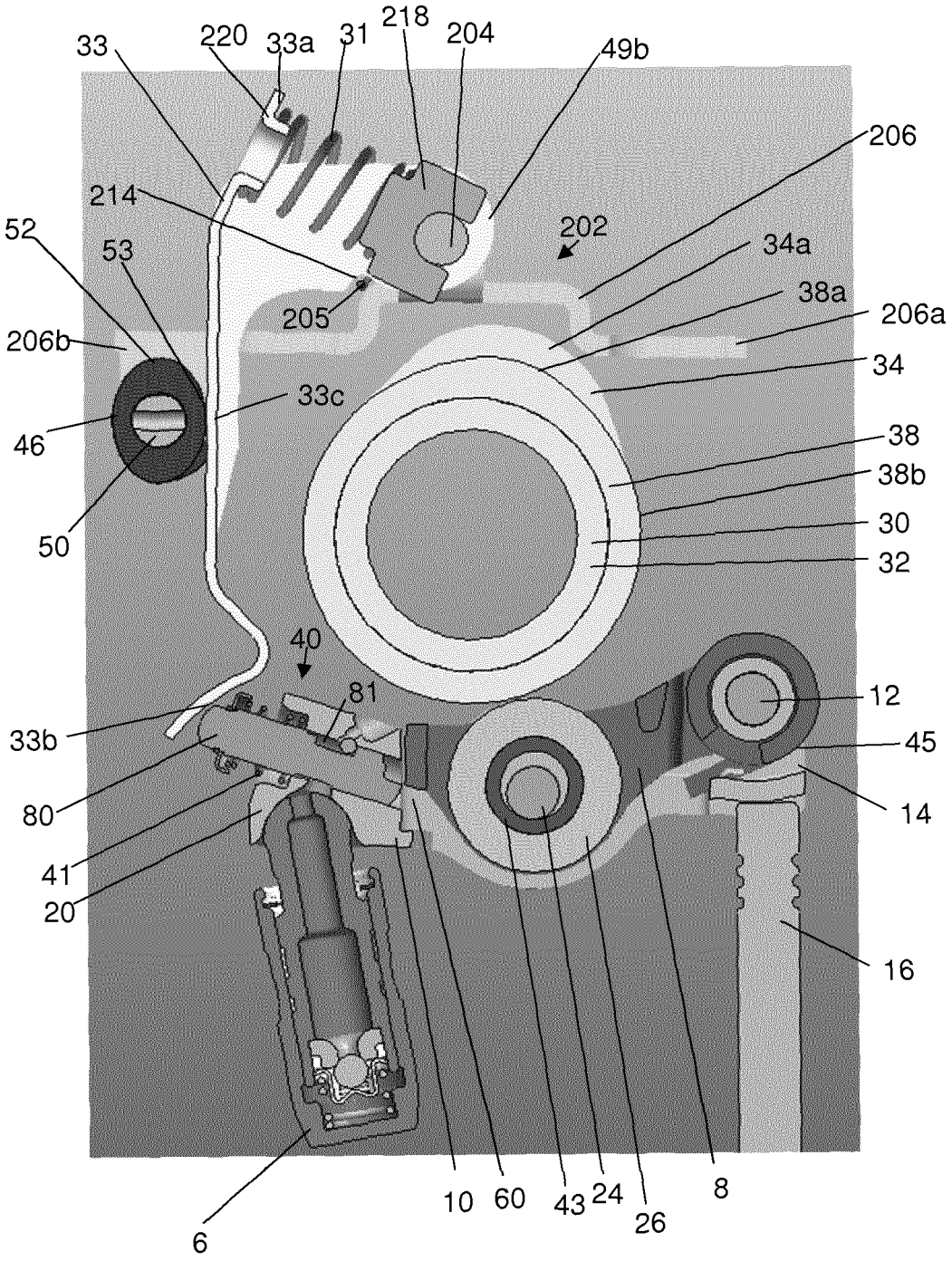
FIG. 5 illustrates schematically a part-sectional view of the valve train assembly of FIG. 1 when the latching arrangement is de-actuated.
Figure 6:
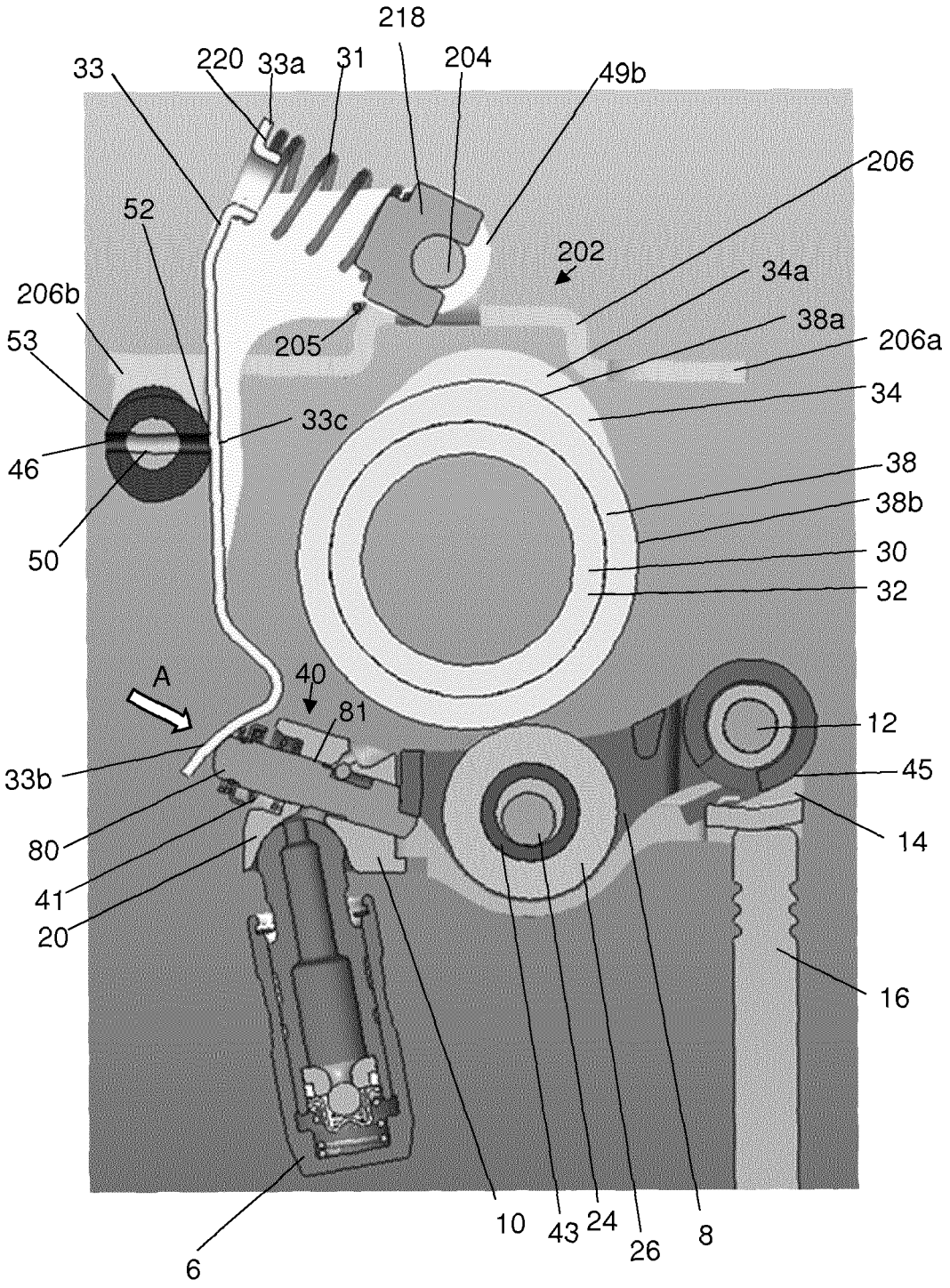
FIG. 6 illustrates schematically a part-sectional view of the valve train assembly of FIG. 1 when latching arrangement is actuated.
Figure 7:
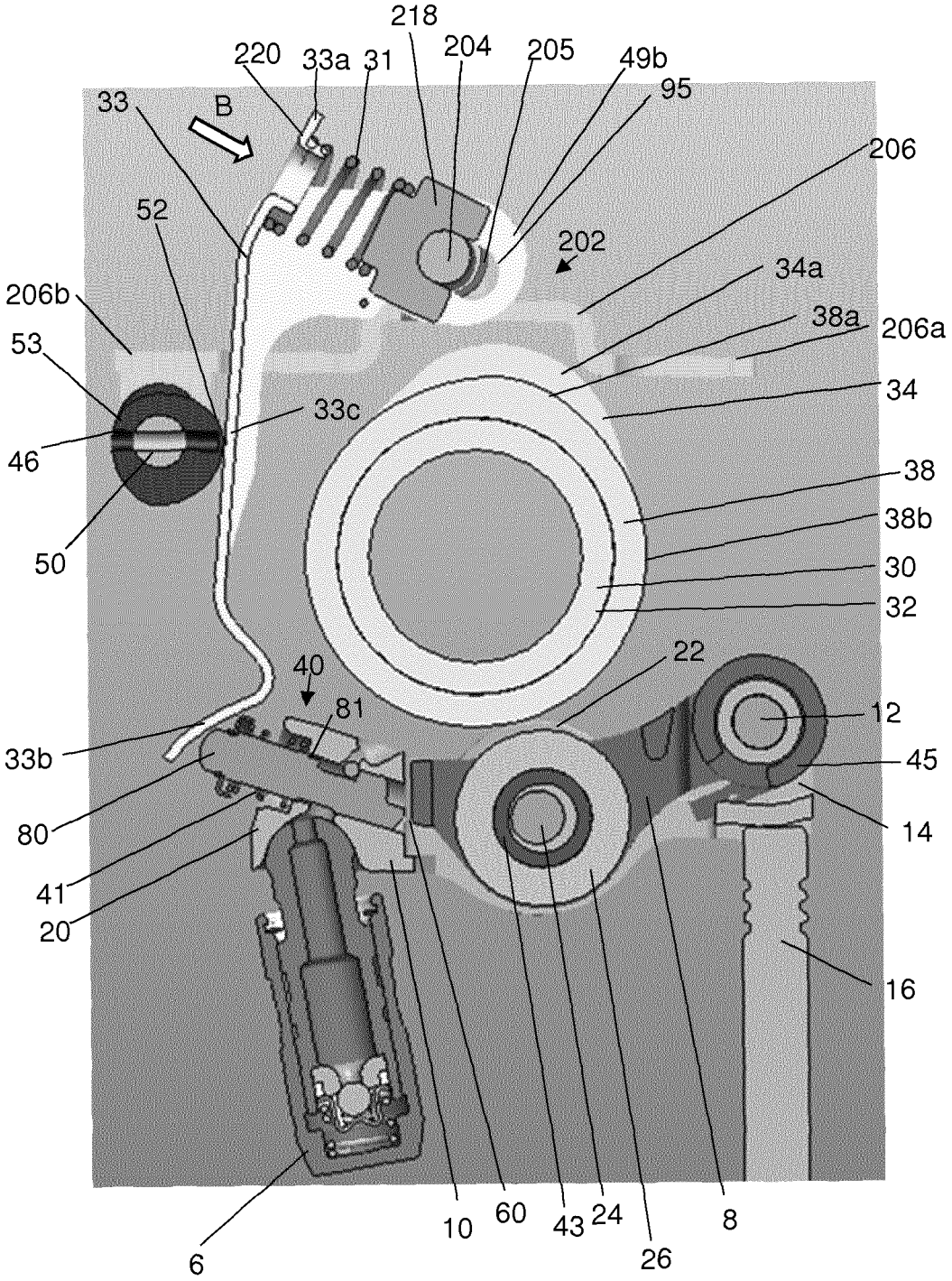
FIG. 7 illustrates schematically a part-sectional view of the valve train assembly of FIG. 1, when the actuation source attempts to actuate the latching arrangement when the latching arrangement is non-actuatable.

As shown in FIGS. 5 to 7, a lobed camshaft 30 includes a rotatable camshaft 32 mounted on which are a main lift cams 34 (only one is shown in the Figures) and a secondary lift cam 38. The main lift cams 34 are for engaging the main lift rollers 22, and the secondary lift cam 38 is for engaging the secondary lift roller 26. The main lift cams 34 include a lift profile (i.e. a lobe) 34*a* and a base circle (not visible in the Figures), and the secondary lift cam 38 includes a lift profile 38*a* and a base circle 38*b*.

The rocker arm 2 provides for switchable or variable valve lift (VVL) functionality. The VVL functionality provided depends on the geometry and/or configuration of the rocker arm 2 and on the number, profile, and relative phase of the main lift cam 34 and the secondary lift cam 38 or other cams. For example, the rocker arm 2 and cams 34, 38 or other cams may be configured to provide for, for example, internal exhaust gas recirculation (iEGR), early exhaust valve opening (EEVO), late intake valve closing (LIVC), dual lift, or cylinder deactivation (CDA).

In one example, the rocker arm 2 is switchable between a first valve lift mode and a second valve lift mode. The first valve lift mode may be a single lift mode which provides a single operation (where a valve operation is an opening and corresponding closing of the valve 4) of the valve 4 per engine cycle (e.g. full rotation of the cam shaft 32), for example just a main valve lift per engine cycle. The second valve lift mode may be a dual lift mode which provides two operations of the valve 4 per engine cycle. In the dual lift mode, the inner body 8 and the outer body 10 are latched together by a latching arrangement 40 and hence act as a single solid body, whereas in the single lift mode the inner body 8 and the outer body 10 are unlatched.

In this example, during engine operation in the dual lift mode, as the cam shaft 32 rotates, the main lift cam's lift profile 34 engages the main lift roller 22 to exert a force that causes the outer body 10 to pivot about the lash adjuster 6 to lift the valve stem 16 (i.e., move it downwards in the sense of the page) against the force of a valve spring thus opening the valve 4. Similarly, as the camshaft 32 continues to rotate, then, at a later stage, the secondary lift cam's lift profile 38*a* engages the secondary lift roller 26 exerting a force on the inner body 8 which force, as the inner body 8 and the outer body 10 are latched together, is transmitted to the outer body 10 causing the outer body 10 to pivot about the lash adjuster 6 to lift the valve stem 16 against the force of a valve spring thus opening the valve 4 a second time during the engine cycle. The lift profile 38*a* may be shallower and narrower than are the lift profiles 34*a* and so consequently the second valve lift event is lower and of a shorter duration than is the first valve lift event.

In this example, during engine operation in the single lift mode, the inner body 8 and the outer body 10 are not latched together by the latching arrangement 40 and hence in this mode, the inner body 8 is free to pivot with respect to the outer body 10 about the shaft 12. During engine operation in the single lift mode, as the cam shaft 32 rotates, when the main lift cam's lift profile 34*a* engages the first main lift roller 22*a*, the outer body 10 pivots about the lash adjuster 6 and, in an identical way as in the dual lift mode, a main valve lift event occurs. As the camshaft 32 continues to rotate, then, the secondary lift cam's lift profile 38*a* engages the secondary lift roller 26 exerting a force on the inner body 8. In the single lift mode, however, as the inner body 8 and the outer body 10 are not latched together, this force is not transmitted to the outer body 10 which hence does not pivot about the lash adjuster 6 and so there is no additional valve event during the engine cycle. Instead, as the secondary lift cam's lift profile 38*a* engages the secondary lift roller 26, the inner body 8 pivots with respect to the inner body 10 about the shaft 12 accommodating the motion that otherwise would be transferred to the outer body 10. A torsional lost motion spring 45 is provided to return the inner body 8 to its starting position relative to the outer body 10, once the peak of the lift profile 38*a* has passed out of engagement with the secondary lift roller 26.

In this example, the arrangement may be used to provide switchable internal Exhaust Gas Recirculation (iEGR) control. For example, if the valve 4 is an exhaust valve for an engine cylinder, the main valve lift acts as the main exhaust lift of an engine cycle, and the timing of the secondary valve lift may be arranged so that it occurs when an intake valve for that cylinder, controlled by a further rocker arm mounted pivotally on a further lash adjuster and which pivots in response to an intake cam mounted on the cam shaft 32, is open. The simultaneous opening of the intake and exhaust valves in this way ensures that a certain amount of exhaust gas remains in the cylinder during combustion which reduces NOx emissions. Switching to the single lift mode deactivates the iEGR function, which deactivation may be desirable under certain engine operating conditions. As will be appreciated by those skilled in the art, this switchable IEGR control may also be provided if the valve 4 is an intake valve with the timing of the secondary valve lift arranged to occur when an exhaust valve for that cylinder is open during the exhaust part of an engine cycle.

It will be readily appreciated that, as mentioned above, the rocker arm 2 may be any rocker arm including a plurality of bodies that move relative to one another, and which are latched together by latching arrangement 40 to provide one mode of operation and are unlatched, and hence can move with respect to each other, to provide a second mode of operation, and that the valve train assembly 1 may be arranged such that the rocker arm 2 may provide for any switchable or variable valve lift (VVL) functionality, such as early exhaust valve opening (EEVO), late intake valve closing (LIVC), dual lift, or cylinder deactivation (CDA), and the like.

Each actuation apparatus 3 is for actuating the latching arrangement 40 of a corresponding rocker arm 2, by transmitting an actuation force from the actuation source 100 to the latch pin 80 of the respective rocker arm 2.

As seen in FIG. 1, the actuation source 100 includes a rotatable shaft 50 mounted on which are selector cams 46, one for each actuation apparatus 3. As seen in FIGS. 5 to 7, each selector cam 46 includes a lift profile 52 and a base circle 53. The lift profile 52 of the selector cam 46 is for applying an actuation force to a lever 33 of the actuation apparatus 3, for causing actuation of the latching arrangement 40 of the rocker arm 2 (described in more detail below). The rotatable camshaft 50 is drivable by a drive mechanism 71, which may be a motor 71, for example an electric motor or a hydraulic motor. When the drive mechanism 71 is controlled to rotate (for example when a lift mode of the rocker arm 2 is desired to be changed), the rotating drive mechanism 71 causes the camshaft 50 to rotate, which in turn causes the selector cam 46 to rotate, so that the lift profile 52 applies an actuation force to the lever 33 of the actuation apparatus 3.

Each actuation apparatus 3 includes a lever 33 and a biasing means such as a spring 31 (also referred to as a compliance spring 31). The actuation apparatus 3, in response to the rotating selector cam 46, actuates (e.g. moves) the latching arrangement 40 so that the latch pin 80 latches the inner body 8 and the outer body 10 together.

As seen in FIGS. 3 to 7, the lever 33 is a generally elongate member. The lever 33 contacts the compliance spring 31 at a first end 33*a* of the lever. A second end 33*b* of the lever 33 is for contacting the latching arrangement 40, specifically the latch pin 80, of the rocker arm 2. The second end 33*b* of the lever 33 is curved so as to form a hook shape. The lever 33 thereby defines an arcuate surface for contacting with the latch pin 80. This may reduce friction between the latch pin 80 and the lever 33 when contacting the latch pin 80, and hence reduce wear thereof. The selector cam 46 contacts the lever 33 on a first side of the lever 33 at a central portion 33*c* of the lever 33, intermediate of the first end 33*a* and the second end 33*b* of the lever.

The lever 33 includes two wings 49*a*, 49*b* at the first end 33*a* of the lever 33. Each of the wings 49*a*, 49*b* extend out from a side of the lever 33 opposite to the side of the lever 33 that the selector cam 46 contacts. The wings 49*a*, 49*b* extend substantially perpendicularly from the lever 33. The two wings 49*a*, 49*b* define between them a space in which the compliance spring 31 is located. Each wing 49*a*, 49*b* defines an elongate aperture or slot 95 extending along the respective wings 49*a*, 49*b*.

The actuation apparatus 3 includes a support 202 arranged to support the lever 33. The support 202 includes a generally cylindrical support rod 204 about which the lever 33 is arranged to pivot. The lever 33 is arranged to pivot about the support rod 204 at the first end 33*a* of the lever 33. Specifically, the support rod 204 is received in the slot 95 of each of the wings 49*a*, 49*b* of the lever 33. In the example shown in the Figures, the support 202 supports two levers 33 in common in this way, although in other examples the support 202 may support more or fewer levers 33.

Figure 4:
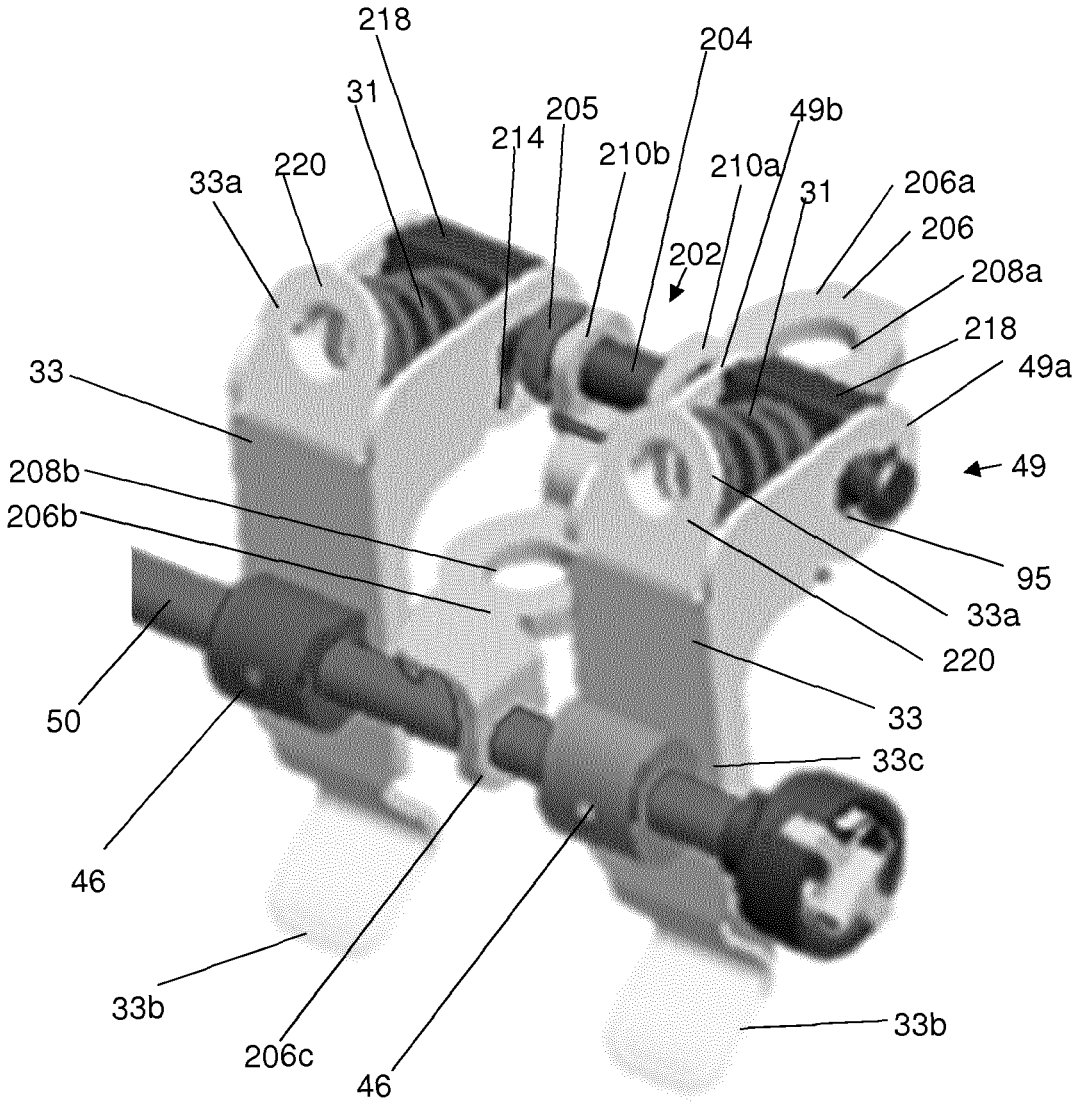
FIG. 4 illustrates schematically a different perspective view of part of the example valve-train assembly illustrated in FIG. 1.

As seen in FIG. 4, in this example, the support 202 includes an attachment means 206 arranged to support the support rod 204, and to attach the actuation apparatus 3 to a part of the internal combustion engine, for example a cam carrier of the internal combustion engine. The attachment means 206 also supports the shaft 50. Specifically, the attachment means 206 includes a generally elongate member 206, and defines two apertures 208*a* and 208*b*, one at each end 206*a*, 206*b* of the member 206, respectively. The apertures 208*a*, 208*b* may receive suitable fixing means, such as a bolt or screw of the like, which may be used to attach the attachment means 206 to the internal combustion engine. The elongate member 206 includes a shaft support portion 206*c* at an end 206*b* of the member 206, which defines an aperture in which the shaft 50 is rotatably received. The attachment means 206 thereby supports the shaft 50. The elongate member 206 includes two support wings 210*a*, 210*b* extending perpendicularly from the elongate member 206, each support wing 210*a*, 210*b* defining an aperture through which the support rod 204 is received. The attachment means 206 thereby supports the support rod 204.

The support 202 includes a biasing means or support spring 205, for example a torsional support spring 205, arranged to bias the lever 33 rotationally with respect to the support rod 204 towards the selector cam 46, i.e. for engagement with the selector cam 26. Specifically, a first end of the torsional support spring 205 contacts the attachment means 206 (which in use is fixed relative to the engine body), and a second end of the torsional support spring 205 is received in a slit 214 in a wing 49*a*, 49*b* of the lever 33. The support spring 205 thereby biases the lever 33 rotationally with respect to the support rod 204 towards the selector cam 46, to ensure correct engagement of the lever with the selector cam 46. In the example shown in the Figures, the support spring 205 biases two levers 33 in common in this way, although in other examples the support spring 205 may bias more or fewer levers 33.

As mentioned above, the support rod 204 is received in the slot 95 in each wing 49*a*, 49*b* of the lever 33, for sliding movement along the length of the slots 95. Each lever 33 may therefore slide relative to its support rod 204 along the length of its slot 95. The compliance spring 31 is received in between the two wings 49*a*, 49*b* of the lever 33. A first end of the compliance spring 31 contacts with a support pad 218 attached to the support rod 204. A second end of the compliance spring 31 contacts a support portion 220 of the lever 33, between the two wings 49*a*, 49*b*, at the first end 31*a* of the lever 33. The compliance spring therefore biases first end 31*a* of the lever 33 away from the support rod 204 and towards the selector cam 46.

In broad overview, in use, when the selector cam 46 attempts to actuate the latching arrangement 40, via the lever 33 when the latching arrangement 40 is non-actuatable (e.g. non-moveable, e.g. unable to be moved, e.g. blocked from being moved, see e.g. FIG. 7), the lever 33 compresses the compliance spring 31, and when the latching arrangement 40 becomes actuatable again (e.g. moveable again, e.g. able to be moved again, e.g. is no longer blocked from being moved, see e.g. FIG. 5), the compliance spring 31 causes the lever 33 to actuate (e.g. move) the latching arrangement 40 (see e.g. FIG. 6).

FIGS. 5 and 7 show the valve train assembly 1 at different times, e.g. at different points in the engine cycle. In FIG. 5, the latching arrangement 40 is actuatable, whereas in FIG. 7 the latching arrangement 40 is non-actuatable.

Referring first to FIGS. 5 and 6, when the selector cam 46 rotates (e.g. clockwise in the sense of FIG. 5) such that its lift profile 52 pushes against the centre portion 33*c* of the lever 33, the lever 33 pivots (rotates) about the support rod 24 (i.e. pivots about the first end 33*a* of the lever 33) such that the second end 33*b* of the lever 33 pushes against the latch pin 80 of the rocker arm 2. Since the latch pin 80 is free to move (i.e. the latching arrangement 40 is actuatable), then the force of second end 33*b* of the lever 33 pushing against the latch pin 80 is sufficient to actuate the latch pin 80 immediately (see arrow A in FIG. 6), hence latching the inner arm 8 and the outer arm 10 together. This latched state is illustrated in FIG. 6. The latching arrangement 40 of the rocker arm 2 may therefore be actuated immediately. Hence the rocker arm 2 may be switched immediately from, say, a second lift mode to a first lift mode as described above.

However, in some cases (such as illustrated in FIG. 7), the latch pin 80 may not be free to move (i.e. the latch pin 80 may be blocked, i.e. the latching arrangement 40 may be non-actuatable). For example, actuation of the latching arrangement 40 may not be possible immediately due to an engine condition. For example the actuation of the latching arrangement 40 may not be possible immediately due to the inner arm 8 of the rocker arm 2 being pivoted down with respect to the outer body 10, and hence blocking the path of the latch pin 80 from moving into the latched position.

In the engine condition as illustrated in FIG. 7, the latch pin 80 of the latching arrangement 40 is blocked from moving. In this example, this has occurred during an engine cycle where the lift profile 38*a* of the secondary lift cam 38 engages the secondary lift roller 26 of the inner arm 8 of the rocker arm 2 and hence the inner arm 8 is rotated with respect to the outer arm 10 about shaft 12, and hence the gap 60 into which the latch pin 80 would otherwise be free to extend is blocked by the inner arm 8 (see FIG. 7).

In this case where the latch pin 80 is not free to move (i.e. the latching arrangement 40 is non-actuatable), then when the selector cam 46 rotates the force of the lift profile 52 of the selector cam 46 pushing against the centre portion 33*c* of the lever 33 will cause the first end 33*a* of the lever 33 to move towards the support rod 24 against the compliance spring 31 (see arrow B in FIG. 7). Because the latch pin 80 is blocked, the force of the lift profile 52 pushing against the first end 33*a* of the lever 33 overcomes the biasing force of the compliance spring 31, and hence the lever 33 slides relative to the support rod 24 in the slots 95 of the lever 33. The force of the lift profile 52 of the selector cam 46 pushing against the centre portion 33*c* of the lever 33 therefore causes the lever 33 to rotate about the latch pin 80, i.e. to rotate about the point at which the lever 33 contacts the latch pin 80, i.e. rotate about the second end 33*b* of the lever 33, and causes the compliance spring 31 to compress (see arrow B in FIG. 7). In other words, the compliance spring 31 absorbs an actuation force from the selector cam 46. This is the state shown in FIG. 7.

As soon as (i.e. the instant that) the latch pin 80 of the latching arrangement 40 becomes actuatable again (i.e. becomes unblocked, i.e. becomes free to move again), the energy stored in the compression of the compliance spring 31 will cause (via lever 33) the latch pin 80 to actuate, hence latching the inner arm 8 and the outer arm 10 together (i.e. the state shown in FIG. 6). More specifically, as soon as the latch pin 80 is free to move, the compressed compliance spring 31 pushing on the first end 33*a* of the lever 33 pushes the lever 33 away from the support rod 204. The lever 33 therefore slides relative to the support rod 204 in the slot 95, and the lever 33 rotates about the lift profile 52 of the selector cam 46, i.e. rotates about the point at which the lever 33 contacts the selector cam, i.e. rotates about the centre portion 33*c* of the lever. The second end 33*b* of the lever therefore pushes the latch pin 80 (see arrow A in FIG. 6), hence latching the inner arm 8 and the outer arm 10 together. In other words, as soon as an engine condition allows for the latching arrangement 40 to be actuated, the compliance spring 31 will expand again and transmit the actuation signal/energy to the latching arrangement 40. For example, the latch pin 80 may be free to be actuated as soon as an engine cycle occurs where the base circle 38*b* of the of the secondary lift cam 38 engages the secondary lift roller 26 of the inner arm 8 of the rocker arm 2 and hence the inner arm 8 is not rotated with respect to the outer arm 10 about shaft 12, and hence the gap 60 into which the latch pin 80 may move is free.

As a result, regardless of the blocked or unblocked state of the latch pin 80, i.e. regardless of whether the latching arrangement 40 is actuatable or non-actuatable, the latch pin 80 may be actuated as soon as it is physically possible to do so, i.e. as soon as the rocker arm 2 is not in a state which blocks actuation of the latch pin 80. The switching of the rocker arm 2 from, say, a second lift mode to a first lift mode as described above, may therefore in effect be delayed with respect to the actuation signal/force coming from the selector cam 46 to the earliest possible time that such actuation is physically possible.

At a later stage, for example when actuation is no longer required, the base circle 53 of the selector cam 46 again engages with the centre portion 33*c* of the lever 33 (as per FIG. 5), and so the second end 33*b* of the lever 33 ceases to apply a force to the latch pin 80, and hence the latch pin 80 may return to its default, unlatched state under force of the return spring 41 that biases the latch pin 80 to its default, unlatched position.

The above solution allows easy packaging and installation of an actuation transmission apparatus 3 on an engine. The solution allows for the actuation to happen as soon as possible, even if actuation of the latching arrangement 40 might not be possible immediately due to the engine condition. The solution is space efficient.

As best seen in FIG. 1, as mentioned above, the valve train assembly 1 includes a plurality of the rocker arms 2 and a respective plurality of the actuation apparatuses 3. The actuation source 100 is common to each of the plurality of actuation apparatuses 3.

Specifically, the shaft 50 includes a plurality of selector cams 46, each one of the plurality of selector cams 46 being for contacting the lever 33 of a respective one of the plurality of actuation apparatuses 3. The common shaft 50 is driven by a single drive mechanism 71 as described above, for example a motor, for example an electric motor. When a change in the valve-lift mode of the plurality of rocker arms 2 is required, the drive mechanism 71 is controlled to rotate, which in turn causes the shaft 50 to rotate, which in turn causes the selector cams 46 of the respective actuation apparatuses 3 to rotate, which in turn, as described above, causes the respective levers 33 to apply a force on the respective latch pins 80 of the respective rocker arms 2. As described above, depending on the engine condition for a particular one of the plurality of rocker arms 2, this force will either result in the immediate actuation of the latch pin 80 and hence change in the valve lift mode of that rocker arm 2, or will result in compression of the compliance spring 31 and hence actuation of the latch pin 80 and change in the valve lift mode of the rocker arm 2 at the next possible moment when the latch pin 80 is not blocked from moving and hence able to be actuated. The actuation apparatus 3 therefore allows the valve lift mode of a plurality of rocker arms 2 to be controlled by a single drive mechanism 71, without complicated control or synchronisation with the particular engine condition for a particular one of the plurality of rocker arms 2, and hence allows for a simple and efficient way to control valve lift modes of switchable rocker arms 2.

As illustrated in FIGS. 8 to 10*d*, in some examples, a first selector cam 46*a* associated with a first 2*a* of the plurality of rocker arms 2 may have a different shape to a second selector cam 46*b* associated with a second 2*b* of the plurality of rocker arms 2, to allow for independent control of the rocker arms 2*a*, 2*b*, by a common actuation source 100.

More specifically, in this example, a first 3*a* of the plurality of actuation apparatuses 3 is arranged to actuate a latching arrangement 40*a* of a first rocker arm 2*a* for controlling a first valve of a cylinder of the internal combustion engine, and a second 3*b* of the plurality of actuation apparatuses 3 is for actuating a latching arrangement 40*b* of a second rocker arm 2*b* for controlling a second valve of that same cylinder of the internal combustion engine. (For example, see also the valve train assembly 1 of FIG. 1, having first and second rocker arms 2*a*, 2*b* for controlling first and second exhaust valves 4*a*, 4*b* respectively of a cylinder, the first and second rocker arms 2*a*, 2*b* having respective latching arrangements 40*a*, 40*b*, and associated actuation apparatuses 3*a*, 3*b*).

Figure 8:
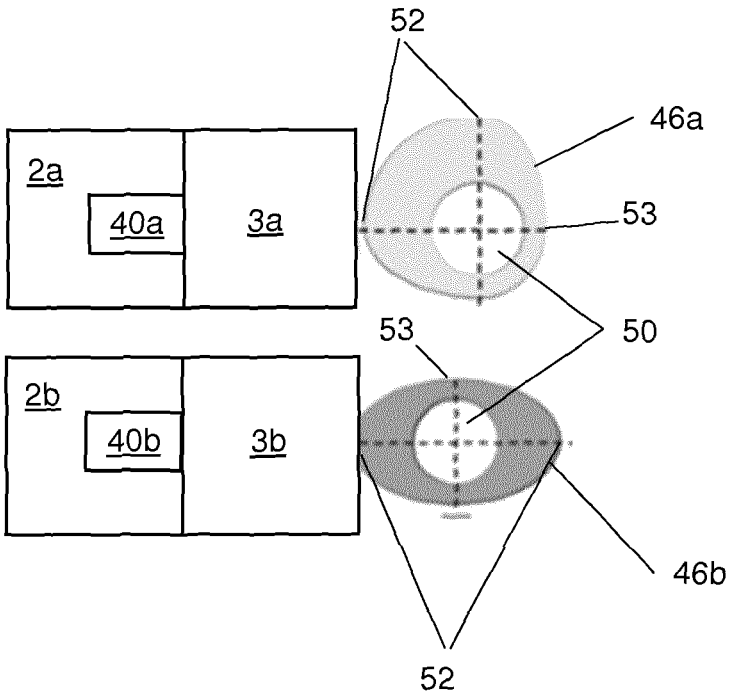
FIG. 8 illustrates schematically a cross section of an actuation source according to an example.

As best seen in FIG. 8, the first selector cam 46*a* arranged to contact the lever of the first actuation apparatus 3*a* is a different shape to the second selector cam 46*b* for contacting the lever of the second actuation apparatus 3*b*, thereby to allow independent control of the first and second valves. Specifically, each selector cam 46*a*, 46*b* includes one or more lobed portions 52 for applying a force to the respective actuation apparatus 3*a*, 3*b*, and includes a base circle portion 53 for applying substantially no force to (for example not contacting) the respective actuation apparatus 3*a*, 3*b*. The first selector cam 46*a* includes two such lobed portions 52 arranged substantially at right angles to one another about a rotational axis of the shaft 50. The second selector cam 46*b* includes two lobed portions 52 arranged substantially opposite one another about a rotational axis of the shaft 25. The first selector cam 46*a*, and the second selector cam 46*b* are fixed on the shaft 50 such that the lobed portions 52 of the second selector cam 46*b* are substantially parallel to one of the two the lobed portions 52 of the first selector cam 46*a*.

This arrangement may allow control over a combination of variable valve lift (VVL) functionality provided by the two rocker arms 2*a*, 2*b*.

For example, the first valve 4*a* and the second valve 4*b* may both be exhaust valves of a cylinder of an internal combustion engine. The first rocker arm 2*a* may provide for a first variable valve lift functionality and the second rocker arm 2*b* may provide for a second, different, variable valve lift functionality.

For example, as illustrated in FIGS. 9*a* to 10*d*, the first rocker arm 2*a* may be arranged for switchable Early Exhaust Valve Opening (EEVO), and the second rocker arm 2*b* may be arranged for switchable internal Exhaust Gas Recirculation (iEGR).

FIGS. 9*a* to 9*d* each illustrate different orientations of the first selector cam 46*a* and the second selector cam 46*b* relative to their respective actuation apparatuses 3*a*, 3*b*. FIGS. 10*a* to 10*d* illustrate a plot of intake and exhaust valve opening against crank angle (e.g. angle of rotation of the lobed camshaft 30) for the orientation of selector cams 46*a*, 46*b* shown FIGS. 9*a* to 9*d*, respectively. As mentioned above, in this example, the valves controlled by the first and second rocker arms 2*a*, 2*b* are exhaust valves, and hence the intake valve opening plot is the same for all of FIGS. 10*a* to 10*d*, and features only a single, symmetrical, main lift of the intake valve per engine cycle. However, different orientations of the selector cams 46*a*, 46*b* cause different combinations of VVL functionality to be provided by the rocker arms 2*a*, 2*b*, controlling the exhaust valves, and hence the exhaust valve opening plot is different for each of the FIGS. 10*a* to 10*d*, as explained below.

Figure 9A:
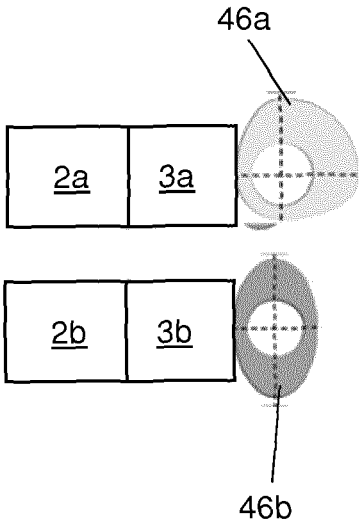
FIGS. 9*a* to 9*d* each illustrate schematically a cross section of an actuation source in a given orientation.
Figure 10A:
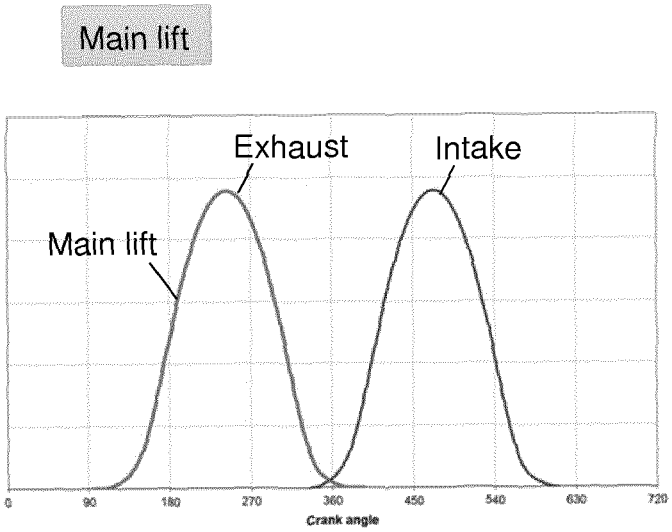
FIGS. 10*a* to 10*d* each illustrate schematically a plot of intake and exhaust valve opening against crank angle corresponding to the actuation source orientation shown in FIGS. 9*a* to 9*d*, respectively.

In FIG. 9*a*, the selector cams 46*a*, 46*b* are orientated such that both have their base circles 53 in contact with the respective actuation apparatuses 3*a*, 3*b* associated with the respective rocker arms 2*a*, 2*b*. Therefore, both the first 2*a* and second 2*b* rocker arms 2 are in a single valve lift mode. As a result, as can be seen in the plot of crank angle of the camshaft 30 against exhaust valve opening in FIG. 10*a*, only a single, symmetrical, main lift of the exhaust valve is provided for per engine cycle.

Figure 9B:
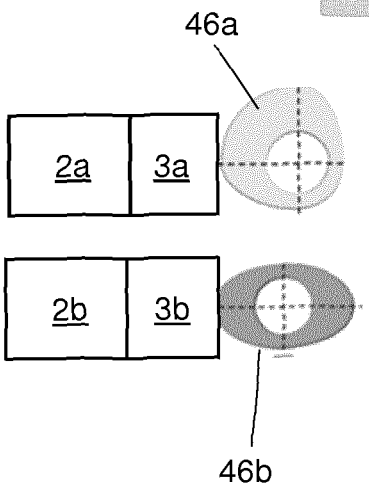
Figure 10B:
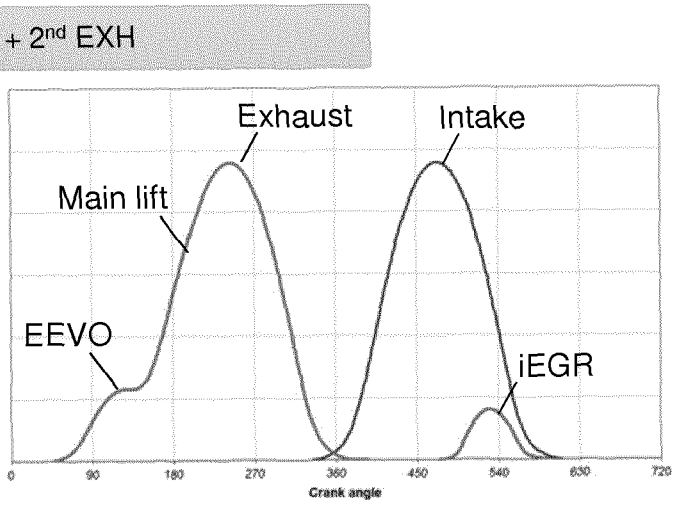

In FIG. 9*b*, the shaft 50 is rotated by 90° counter clockwise relative to FIG. 9*a* in the sense of FIGS. 9*a* and 9*b*. The selector cams 46*a*, 46*b* are therefore orientated such that both have a lobed portion 52 in contact with the respective actuation apparatuses 3*a*, 3*b* associated with the respective rocker arms 2*a*, 2*b*. Therefore, the latching arrangements 40*a*, 40*b* of both the first 2*a* and second 2*b* rocker arms 2 will be actuated by the actuation apparatuses 3*a*,3*b* as described above, and hence both rocker arms 2*a*, 2*b* will be in a dual valve lift mode. As a result, as can be seen in the plot of crank angle of the cam against exhaust valve opening in FIG. 10*b*, three exhaust valve opening features are provided for: EEVO, main lift, and iEGR.

Figure 9C:
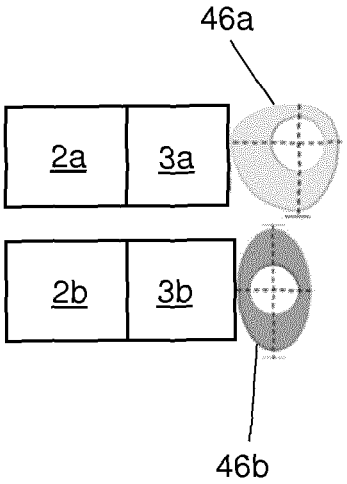
Figure 10C:
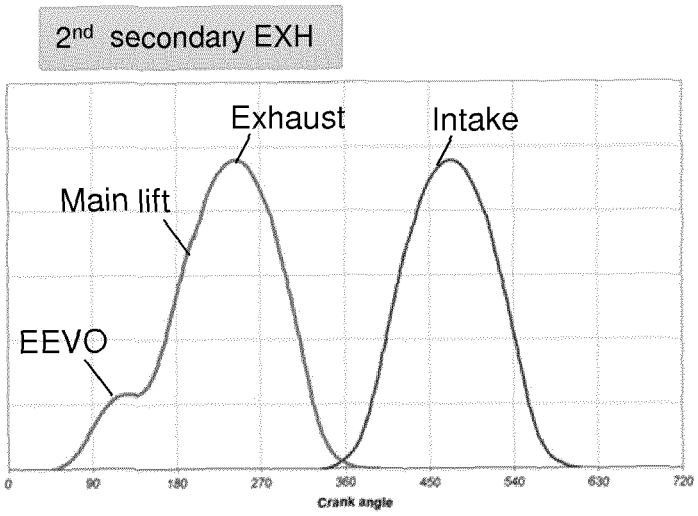

In FIG. 9*c*, the shaft is rotated by 90° counter clockwise relative to FIG. 9*b* in the sense of FIGS. 9*b* and 9*c*. The first selector cam 46*a* is orientated such that it has its lift profile 52 in contact with the first actuation apparatus 3*a*, and the second selector cam 46*b* is orientated such that its base circle 53 is in contact with the second actuation apparatus 3*b*. Therefore, the latching arrangement 40*a* of the first rocker 2*a* arm will be actuated, but the latching arrangement 40*b* of the second rocker arm 2*b* will not be actuated by the respective actuation apparatuses 3*a*, 3*b*. Therefore the first rocker arm 2*a* will be in a dual valve lift mode, but the second rocker 2*b* arm will be in a single valve lift mode. As a result, as can be seen in the plot of crank angle of the cam against exhaust valve opening in FIG. 10*c*, two exhaust valve opening features are provided for: EEVO and main lift.

Figure 9D:
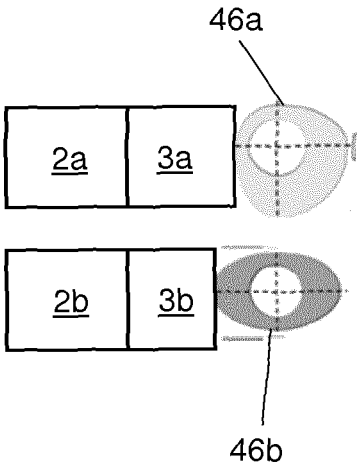
Figure 10D:
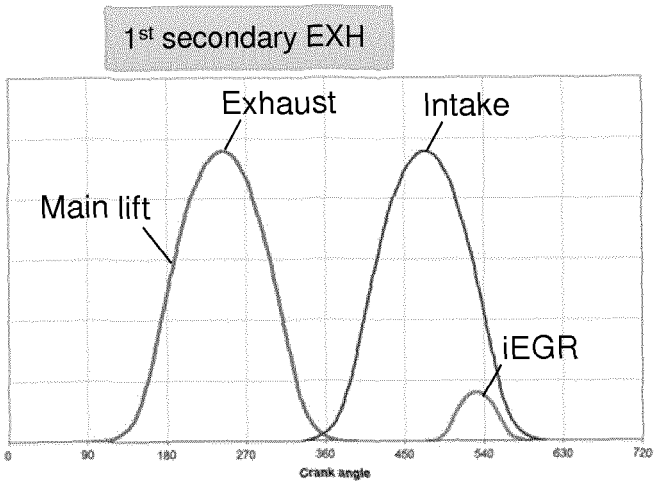

In FIG. 9*d*, the shaft is rotated by 90° counter clockwise relative to FIG. 9*c* in the sense of FIGS. 9*c* and 9*d*. The first selector cam 46*a* is orientated such that it has its base circle 53 in contact with the first actuation apparatus 3*a*, and the second selector cam 46*b* is orientated such that its lift profile 52 is in contact with the second actuation apparatus 3*b*. Therefore, the latching arrangement 40*a* of the first rocker arm 2*a* will not be actuated, but the latching arrangement 40*b* of the second rocker arm 2*b* will be actuated by the actuation apparatus 3*b* as described above. Therefore the first rocker arm 2*a* will be in a single valve lift mode, but the second rocker 2*b* arm will be in a dual valve lift mode. As a result, as can be seen in the plot of crank angle of the cam against exhaust valve opening in FIG. 10*d*, two exhaust valve opening features are provided for: main lift, and iEGR.

It will be appreciated that although in this example the first rocker arm 2*a* provides switchable EEVO and the second rocker arm 2*b* provides switchable iEGR, this need not necessarily be the case and any combination of switchable valve lift functionality may be provided.

The above example arrangement may be applied to each pair of rocker arms 2 of each of the cylinders of the internal combustion engine.

This example therefore allows for control over a combination of variable valve lift (VVL) functionality provided by rocker arms 2. Moreover, the actuation apparatuses 3 each allow for a change in the valve lift mode of the rocker arm 2 at the next possible moment when the latch pin 80 is not blocked from moving and hence able to be actuated. The actuation apparatuses 3 therefore allow the valve lift mode of the plurality of rocker arms 2 to be controlled by a single drive mechanism 71, without complicated control or synchronisation with the particular engine condition for the plurality of rocker arms 2, and hence allows for a simple and efficient way to control a combination of variable valve lift (VVL) functionality provided by the rocker arms 2.

The above are to be understood as illustrative examples only. For example, an actuation apparatus 3 may be used to actuate (or indeed de-actuate) any suitable switchable engine or valve train component.

It will be appreciated that although in the above examples the lever 33 has an elongate slot 95 in which a support rod 54 is received and is slidable, this need not necessarily be the case, and other examples may use other sliding means. In other examples, the lever may be moveable along some other sliding means, such as a rail or the like.

It is to be understood that any feature described in relation to any one embodiment may be used alone, or in combination with other features described, and may also be used in combination with one or more features of any other of the embodiments, or any combination of any other of the embodiments. Furthermore, equivalents and modifications not described above may also be employed without departing from the scope of the invention, which is defined in the accompanying claims.

While embodiments of the invention have been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

REFERENCE SIGNS LIST

1 valve train assembly
2, 2*a*, 2*b* rocker arm
3, 3*a*, 3*b* actuation apparatus
4, 4*a*, 4*b* valve
6 lash adjuster
8 inner body
10 outer body
12 shaft
14 first end of outer body
16 valve stem
20 second end of outer body
22 main lift roller
24 axle
26 secondary lift roller
30 lobed camshaft
31 compliance spring
32 rotatable camshaft
33 lever
33*a*, 33*b* lever ends
33*c* lever centre portion
34 main lift cam
38 secondary lift cam
40 latching arrangement
41 return spring
43 inner bushing/axle
45 torsional lost motion spring
46, 46*a*, 46*b* selector cam
49*a*, 49*b* wings
50 shaft
52 lift profile
53 base circle
54 support rod
60 gap
71 drive mechanism
80 latch pin
81 bore
95 slot
100 actuation source
202 support
204 support rod
205 torsional support spring
206 attachment means
206*a*, 206*b* attachment means end
208*a*, 208*b* aperture
210*a*, 210*b* support wing
214 slit
218 support pad
220 support portion

The invention claimed is:

1. An actuation apparatus for actuating a latching arrangement of a switchable valve train component of an internal combustion engine, the apparatus comprising:

a lever configured to contact an actuation source and configured to contact the latching arrangement; and a bias, wherein the bias contacts the lever, wherein the bias is configured such that, in use, the bias becomes biased by the lever when the actuation source moves the lever when the actuation source attempts to actuate the latching arrangement, via the lever, when the latching arrangement is non-actuatable, whereby the bias causes the lever to actuate the latching arrangement when the latching arrangement is actuatable again, wherein the lever contacts the bias at a first end of the lever, wherein a second end of the lever, opposite to the first end of the lever, is configured to contact the latching arrangement, and wherein the lever is configured such that, in use, the lever rotates about the second end when the actuation source moves the lever when the actuation source attempts to actuate the latching arrangement, via the lever, when the latching arrangement is non-actuatable.

2. The actuation apparatus according to claim 1, wherein the lever is configured such that, in use, the lever rotates about the first end of the lever when the actuation source attempts to actuate the latching arrangement, via the lever, when the latching arrangement is actuatable.

3. The actuation apparatus according to claim 1, wherein a central portion of the lever, intermediate of the first end and the second end of the lever, is configured to contact the actuation source.

4. The actuation apparatus according to claim 3, wherein the lever is configured such that, in use, the lever rotates about the central portion when the bias causes the lever to actuate the latching arrangement when the latching arrangement is actuatable again.

5. The actuation apparatus according to claim 1, wherein the actuation apparatus comprises a support arranged to support the lever, wherein the lever is arranged for sliding movement relative to the support, and wherein the actuation source is configured such that, in use, the actuation source slides the lever relative to the support, against the bias, when the actuation source moves the lever when the latching arrangement is non-actuatable.

6. The actuation apparatus according to claim 5, wherein the support comprises a support rod about which the lever is arranged to pivot, and the actuation apparatus comprises a further bias arranged to bias the lever rotationally with respect to the support rod for engagement with actuation source.

7. A valve train assembly for an internal combustion engine, the valve train assembly comprising:

the actuation apparatus according to claim 1;

the actuation source; and the switchable valve train component comprising the latching arrangement.

8. The valve train assembly according to claim 7, wherein the switchable valve train component is a switchable rocker arm comprising a first body and a second body arranged to pivot relative to the first body, and wherein the latching arrangement is moveable from an unlatched position in which the first body and the second body are unlatched to provide a first mode of operation, to a latched position in which first body and the second body are latched together to provide for a second mode of operation.

9. The valve train assembly according to claim 8, wherein the rocker arm comprises a bias configured to bias the latching arrangement from the latched position to the unlatched position.

10. The valve train assembly according to claim 7, wherein the actuation source comprises a shaft comprising a selector cam, and wherein the selector cam comprises a lift profile configured to apply a force to the lever for causing actuation of the latching arrangement.

11. The valve train assembly according to claim 10, comprising a plurality of the switchable valve train components and a respective plurality of the actuation apparatuses, wherein the shaft comprises a plurality of the selector cams, each one of the plurality of selector cams being configured to contact the lever of a respective one of the plurality of actuation apparatuses.

12. The valve train assembly according to claim 11, wherein:

a first of the plurality of actuation apparatuses is configured to actuate a latching arrangement of a first switchable valve train component configured to control a first valve of a cylinder of the internal combustion engine; and a second of the plurality of actuation apparatuses is configured to actuate a latching arrangement of a second switchable valve train component configured to control a second valve of the cylinder of the internal combustion engine;

wherein the selector cam configured to contact the lever of the first actuation apparatus is a different shape to the selector cam configured to contact the lever of the second actuation apparatus, the different shape allowing independent control of the first valve and the second valve.

13. An actuation apparatus for actuating a latching arrangement of a switchable valve train component of an internal combustion engine, the apparatus comprising:

a lever configured to contact an actuation source and configured to contact the latching arrangement; and a bias, wherein the bias contacts the lever, wherein the bias is configured such that, in use, the bias becomes biased by the lever when the actuation source moves the lever when the actuation source attempts to actuate the latching arrangement, via the lever, when the latching arrangement is non-actuatable, whereby the bias causes the lever to actuate the latching arrangement when the latching arrangement is actuatable again, wherein the lever contacts the bias at a first end of the lever, wherein a second end of the lever, opposite to the first end of the lever, is configured to contact the latching arrangement, wherein a central portion of the lever, intermediate of the first end and the second end of the lever, is configured to contact the actuation source, and wherein the lever is configured such that, in use, the lever rotates about the central portion when the bias causes the lever to actuate the latching arrangement when the latching arrangement is actuatable again.

14. A valve train assembly for an internal combustion engine, the valve train assembly comprising:

an actuation source;

a switchable valve train component of the internal combustion engine, the switchable valve train component comprising a latching arrangement; and an actuation apparatus for actuating the latching arrangement, the actuation apparatus comprising:

a lever configured to contact the actuation source and configured to contact the latching arrangement; and a bias, wherein the bias contacts the lever, wherein the bias is configured such that, in use, the bias becomes biased by the lever when the actuation source moves the lever when the actuation source attempts to actuate the latching arrangement, via the lever, when the latching arrangement is non-actuatable, whereby the bias causes the lever to actuate the latching arrangement when the latching arrangement is actuatable again, wherein the actuation source comprises a shaft comprising a selector cam, and wherein the selector cam comprises a lift profile configured to apply a force to the lever for causing actuation of the latching arrangement.

15. The valve train assembly according to claim 14, comprising a plurality of the switchable valve train components and a respective plurality of the actuation apparatuses, wherein the shaft comprises a plurality of the selector cams, each one of the plurality of selector cams being configured to contact the lever of a respective one of the plurality of actuation apparatuses.

16. The valve train assembly according to claim 15, wherein:

a first of the plurality of actuation apparatuses is configured to actuate a latching arrangement of a first switchable valve train component configured to control a first valve of a cylinder of the internal combustion engine; and a second of the plurality of actuation apparatuses is configured to actuate a latching arrangement of a second switchable valve train component configured to control a second valve of the cylinder of the internal combustion engine;

wherein the selector cam configured to contact the lever of the first actuation apparatus is a different shape to the selector cam configured to contact the lever of the second actuation apparatus, the different shape allowing independent control of the first valve and the second valve.

* * * * *